US006930582B2

(12) United States Patent
Ball

(10) Patent No.: US 6,930,582 B2
(45) Date of Patent: Aug. 16, 2005

(54) SELF LEAD FOIL WINDING CONFIGURATION FOR TRANSFORMERS AND INDUCTORS

(75) Inventor: Newton E. Ball, Cypress, CA (US)

(73) Assignee: Iota Engineering Co., Tucson, AZ (US)

( * ) Notice: Subject to any disclaimer, the term of this patent is extended or adjusted under 35 U.S.C. 154(b) by 71 days.

(21) Appl. No.: 10/614,493

(22) Filed: Jul. 7, 2003

(65) Prior Publication Data

US 2004/0004529 A1 Jan. 8, 2004

Related U.S. Application Data

(63) Continuation-in-part of application No. 09/707,661, filed on Nov. 7, 2000, now Pat. No. 6,642,830.

(51) Int. Cl.[7] ..... H01F 27/29
(52) U.S. Cl. ..... 336/192; 336/200
(58) Field of Search ..... 336/65, 83, 107, 336/192, 198, 200, 220–223, 206–208

(56) References Cited

U.S. PATENT DOCUMENTS

| | | | | |
|---|---|---|---|---|
| 4,368,407 A | | 1/1983 | Wroblewski | |
| 5,027,412 A | | 6/1991 | Hayashi et al. | |
| 5,117,215 A | * | 5/1992 | Kakehashi et al. | 336/178 |
| 5,515,021 A | | 5/1996 | Rynkiewicz | |
| 5,805,045 A | * | 9/1998 | Henninger | 336/192 |
| 6,010,362 A | | 1/2000 | Caviness et al. | |
| 6,080,935 A | | 6/2000 | Lanoue et al. | |
| 6,087,922 A | | 7/2000 | Smith | |
| 6,222,437 B1 | * | 4/2001 | Soto et al. | 336/200 |

* cited by examiner

*Primary Examiner*—Tuyen T Nguyen
(74) *Attorney, Agent, or Firm*—Quarles & Brady Streich Lang, LLP

(57) ABSTRACT

A coil has foil conductor windings which are formed into self leads and provide a stable mount to a printed circuit board or the like. End portions of the foil windings, having conductive opposite sides, are cut and formed into stacks. The stack configuration forms the self leads of the foil winding and facilitates the winding's exit from the coil. The self leads extend from the coil and are formed to reach to the printed circuit board (PCB). The self leads are strong enough to mount the coil to the PCB. The ends of the self leads are trimmed to fit through holes in the PCB. After insertion, the layers of the self leads are bent in opposing directions to substantially block the hole, prevent extraction, and prevent solder from flowing through the holes. The self leads are then soldered to the board. A bobbin having discontinuous flanges facilitates the exits of the self leads from the coil. The invention is useful in coils, inductors, transformers, and the like.

12 Claims, 7 Drawing Sheets

SELF LEAD FOIL WINDING CONFIGURATION FOR TRANSFORMERS AND INDUCTORS

RELATED APPLICATION INFORMATION

This is a continuation-in-part of application Ser. No. 09/707,661 filed Nov. 7, 2000 now U.S. Pat. No. 6,642,830.

BACKGROUND OF THE INVENTION

1. Field of the Invention

This invention is related in general to the field of inductors, in particular, to transformers, inductors, and coils which are mounted on printed circuit boards or the like.

2. Description of the Related Art

Foil windings are becoming usual in a variety of electrical inductance applications. They are used in coils, inductors, and transformers of many varieties and applications. Their uses range from children's toys, to household appliances, to high technology and aerospace applications.

While the advantages of foil windings are acknowledged, there continues to be some problems associated with the use of foil windings and similar winding materials such as parallel bonded magnet wire. One problem is connecting the foil winding to round wires. Round wires are typically used to conduct electric current to or from the foil winding. The cross section of the round wire is usually significantly less than the cross section of the foil. The result is local heating at the connection point, loss of energy, and higher failure rate.

Another problem is wrapping foil windings on a bobbin. Prior art bobbins (see FIG. 1) are useful when the windings comprise many layers of fine wire. However, as the width of the wire increases, the bobbin flanges cause the exits from early windings to interfere with later windings. This decreases the number of turns which the bobbin can accommodate on a single layer. This interference increases with wire size. The interference is even worse for parallel bonded magnet windings and even more serious for foil windings. For switching power supplies, increases in power levels and increases in switching frequency tend to require a decrease in the number of turns in a winding and an increase in the width of a winding turn. Under these conditions the interference caused by the exits from various windings becomes even more serious.

The prior art has attempted to solve these bobbin problems by cutting deep slots in the bobbin flanges to allow exits of early windings, however, increases in the width of the windings has required ever wider slots in the flanges.

Clearly there exists the need for an improved coil configuration which solves the problems associated with connecting a round wire to a foil winding, reduces interference from exits of windings, reduces energy loss, reduces local heating, and improves reliability.

BRIEF SUMMARY OF THE INVENTION

The invention discloses a coil winding configuration for use in transformers, inductors, and the like. The invention is particularly useful with foil or parallel bonded magnet windings. End portions of a foil winding, having conductive opposite sides, are cut into flag shapes and folded to form a conductive stack of foil conductor. The stack configuration forms self leads of the foil winding and facilitates the winding's exits from the coil. The self leads extend from the coil and are formed to reach to a printed circuit board (PCB).

The self leads are strong enough serve as a mount for securing the coil to the PCB. The ends of the self leads are trimmed to fit through at least one hole in the PCB. After insertion, the layers of the self leads are bent in opposing directions to substantially block the hole, prevent extraction, and block the flow of solder through the hole. The self leads are then soldered to the board. A bobbin having discontinuous flanges facilitates the exits of the self leads from the coil.

The flag shaped pieces are formed by making longitudinal cuts in the ends of the foil conductor, having conductive opposite sides. One or more cuts are made depending on the desired shape of the resulting stack. The flag shaped pieces are folded to form a conductive stack which is at an angle to the foil conductor. This process is performed for both ends of the foil conductor to form self leads for both exits from the coil. The dimensions of the conductive stack are adaptable to many applications. After the foil is wound on the bobbin, the conductive stacks extend from the coil and form the self leads.

The self leads preferably extend from opposing sides of the coil. The leads are bent as needed to reach a mounting board such as a PCB or the like. The leads are strong enough to function as stable mounts for the coil, transformer, or inductor. This eliminates that need for some other mounting fasteners thus reducing costs.

The leads are trimmed to fit through the receiving holes in the board. The preferred embodiment trims each lead into two legs which are inserted through two adjacent round holes in the board. After the leads are inserted into the holes, the layers are bent in opposing directions. This serves to secure the leads to the board and to block the holes to reduce the flow of solder through the holes during the flow solder process.

The new bobbin shape facilitates the exits of the self leads. A key feature are flanges of the bobbin which are discontinuous. Portions of the flanges are formed to be planar with the body of the bobbin. The preferred embodiment has four flange portions which are planar with the bobbin body. The concept may be adapted to various bobbin and core shapes. This new bobbin shape is especially useful with parallel bonded magnet wire or with foil windings. Using the new bobbin, conductor exits do not interfere with the windings. This typically allows for one more turn per layer of single or parallel bonded magnet wire than would fit on a traditional bobbin. The flanges still protect the winding's insulation from the sharp corners of the core; but in their new position, they do not interfere with lead exits. Isolation between the primary and secondary windings are improved further by placing the primary and secondary lead exits on opposite sides of the core.

Therefore, an object of the invention is to provide an improved self lead winding configuration for coils, transformers, inductors, and the like.

A feature of the invention is a conductive stacked self lead which serves as a mount to a board (e.g., PCB).

Another feature of the invention is a conductive stacked self lead inserted through a hole in a board and blocking the hole by bending layers of the self lead in opposing directions.

Another feature of the invention is a bobbin having a discontinuous flange portion parallel with the body of the bobbin.

Advantages of the invention include reduced energy loss, eliminating local heating where a round lead previously connected to the foil winding, improved reliability, increased number of turns on a single layer of the bobbin (or reduced bobbin size), and isolation between primary and secondary windings. However, to achieve the benefit of reduced energy loss and to reduce local heating, it is necessary that foil end portions have conductive opposite sides.

Various other purposes and advantages of the invention will become clear from its description in the specification that follows and from the novel features particularly pointed out in the appended claims. Therefore, to the accomplishment of the objectives described above, this invention consists of the features hereinafter illustrated in the drawings, fully described in the detailed description of the preferred embodiment and particularly pointed out in the claims. However, such drawings and description disclose only one of the various ways in which the invention may be practiced.

DESCRIPTION OF THE PREFERRED EMBODIMENT OF THE INVENTION

Figure 2A:
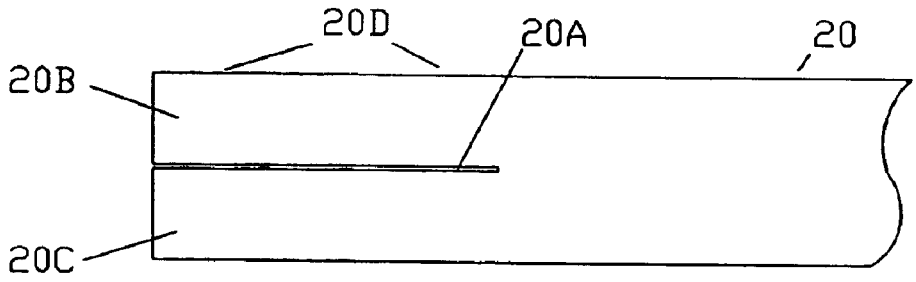
FIGS. 2A, 2B, and 2C illustrate the steps to form conductive stacked self leads on a foil conductor.
Figure 2B:
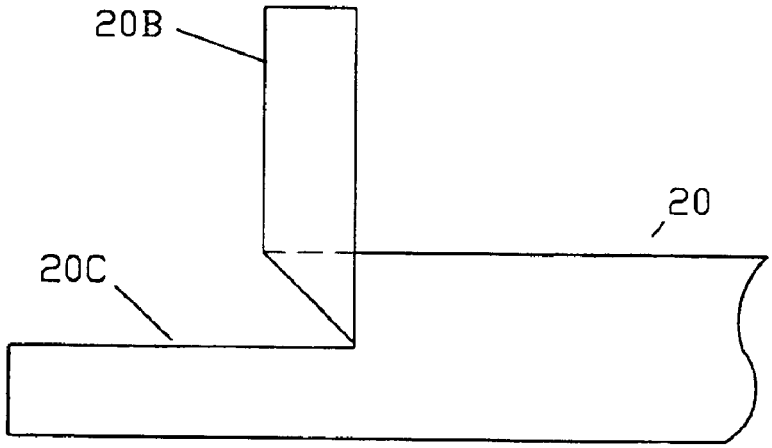
Figure 2C:
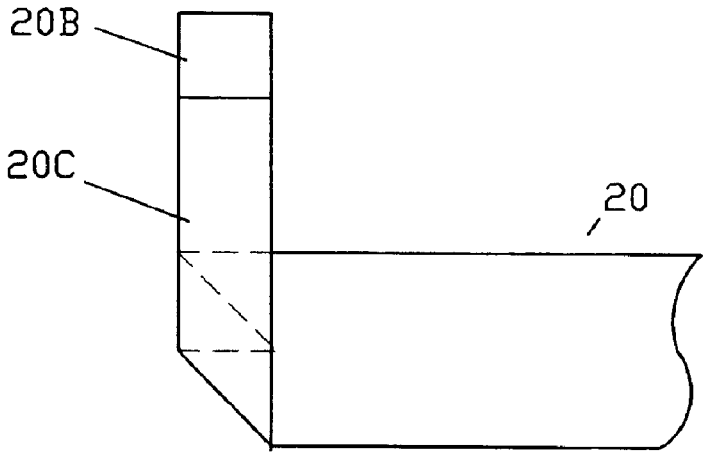

FIGS. 2A thru 2C illustrate forming the conductive stacked self leads. FIG. 2A illustrates foil conductor 20, having conductive opposite sides, cut in the longitudinal direction of the end portion 20D of conductor 20 forming slot 20A. Slot 20A divides conductor 20 into two flag shaped portions 20B and 20C. Slot 20A is made sufficiently long so that the resulting conductive stacked self leads will reach the mounting board. FIG. 2B illustrates the second step in forming the conductive stacked self leads. Flag shaped portion 20B is folded at an angle to foil conductor 20. FIG. 2C illustrates flag shaped portion 20C folded at an angle to foil conductor 20 to overlap flag shaped portion 20B and forming a conductive stack. The end of flag shaped portion 20B is trimmed to match the length of flag shaped portion 20C. By utilizing a foil conductor having conductive opposite sides, the resulting conductive stack has a relatively large cross sectional area that facilitates the flow of electricity. This reduces local heating and associated energy loss.

Those of ordinary skill in the art recognize that several variations of this process are possible. Multiple slots 20A may be cut in foil conductor 20 to form multiple conductive flag shaped portions. This will make more layers in the conductive stack; however, the stack will be narrower. Also, the slot or slots may be of zero width, that is, the slots may be a sheared separation with no removed material. The sheared separation performs that same function as a narrow slot.

The forming of the conductive stack is done to both ends of foil conductor 20; preferably prior to winding conductor 20 onto the bobbin. Foil conductor 20 is wound onto a bobbin such that the conductive stacks extend from the bobbin; thus forming the self leads 30. Once foil conductor 20 is wound on a bobbin it will also be referred to as a foil winding for purposes of this application. The self leads are strong enough to mount a transformer or similar device to a mounting board such as a PCB or the like. Mounting the self leads directly to the PCB eliminates the problems associated with connecting a round wire to the foil conductor 20. This increases reliability while aiding in the reduction of local heating and energy loss. Further, the self leads provide a stable mount for even a relatively heavy device (e.g., transformer); thus eliminating the need for some of the mounting means used in the prior art.

Figure 3A:
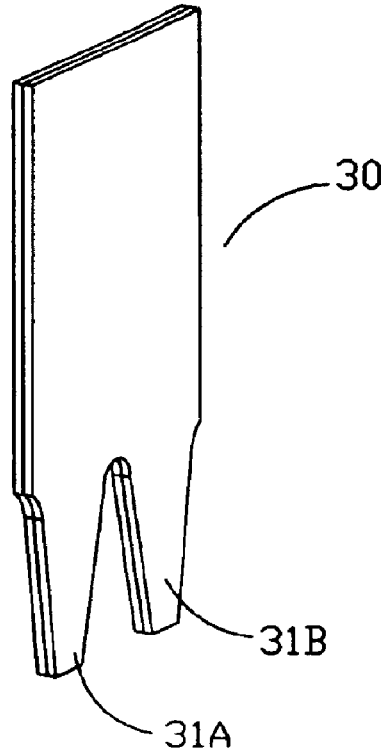
FIGS. 3A and 3B illustrate attachment of conductive stacked self leads to a printed circuit board.
Figure 3B:
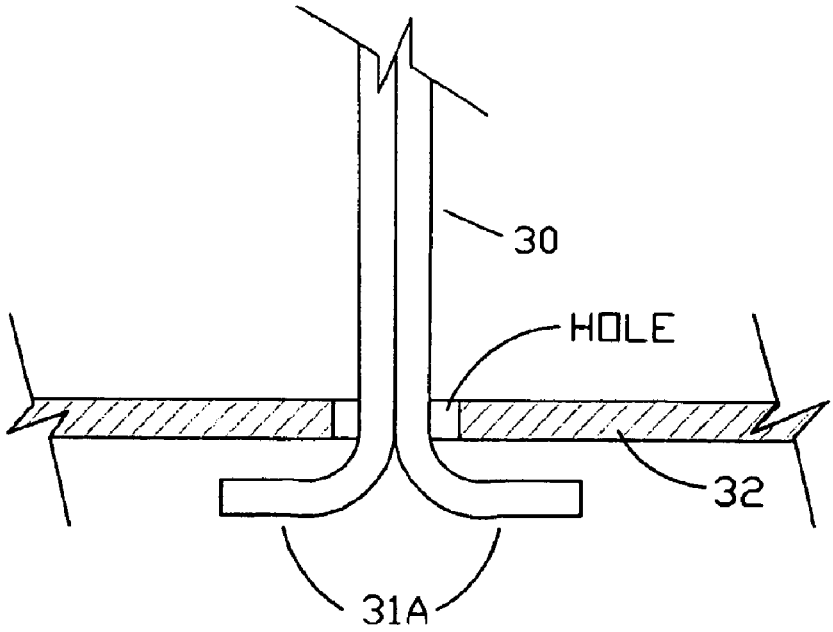

FIGS. 3A and 3B illustrate the attachment of the self leads to a PCB. The ends of self leads 30 are trimmed into two legs 31A and 31B (see FIG. 3A). Legs 31 are trimmed to fit through two round holes in a PCB. Legs 31 are inserted into holes and the layers of the legs 31 are bent in opposing directions to secure lead 30 to board 32. The bent legs 31 substantially block the holes in board 32 and prevent the flow of solder though the holes during the flow solder process.

Figure 3C:
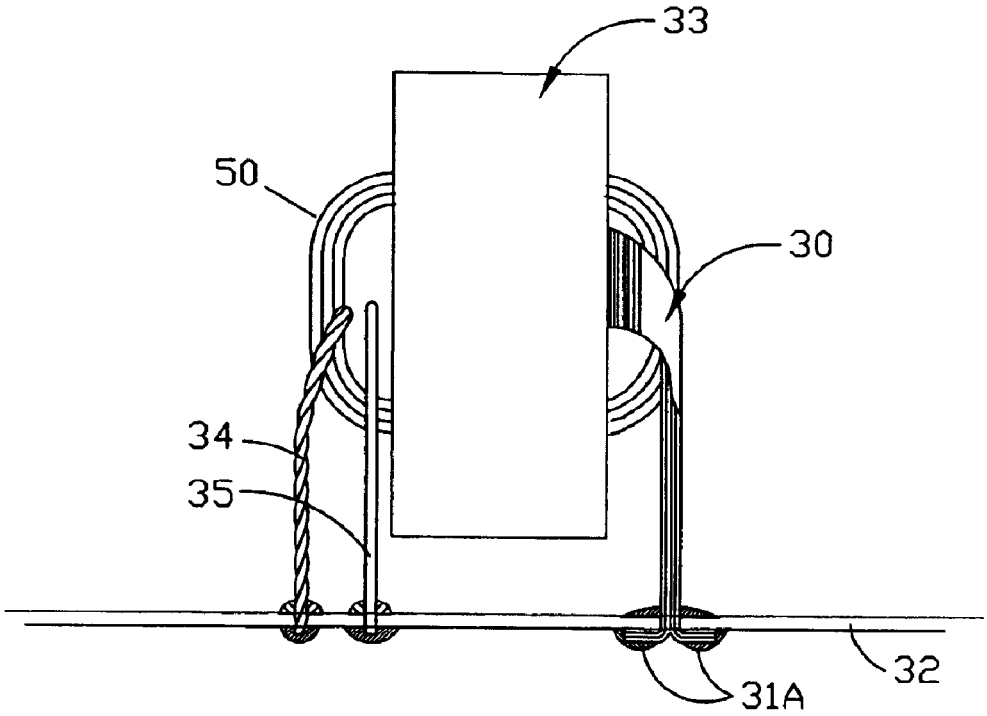
FIG. 3C shows the preferred embodiment of the invention mounting a transformer to a PCB.

FIG. 3C shows the preferred embodiment mounting a transformer to a PCB. Self leads 30 extend from transformer 33. Leads 30 are bend to reach to board 32. Leads 30 are trimmed as shown in FIG. 3A and are attached to board 32 as shown in FIG. 3B. In this embodiment, the copper foil self leads are used only for the secondary winding. Primary windings 34 and auxiliary winding 35 extend from the opposite side of transformer 33. Primary windings 34 and auxiliary winding 35 are soldered to board 32 and complete the mounting of transformer 33 to board 32. Those skilled in the art understand that the invention may be used for either the secondary windings, primary windings, or both, depending on the application.

Figure 1:
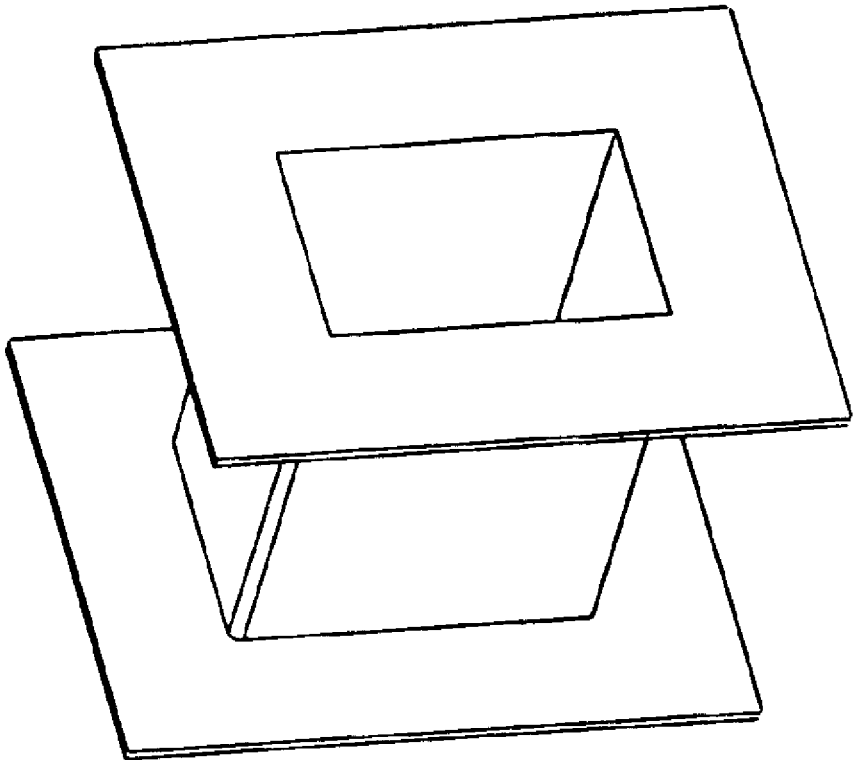
(PRIOR ART) FIG. 1
FIG. 1 illustrates a prior art bobbin.
Figure 4:
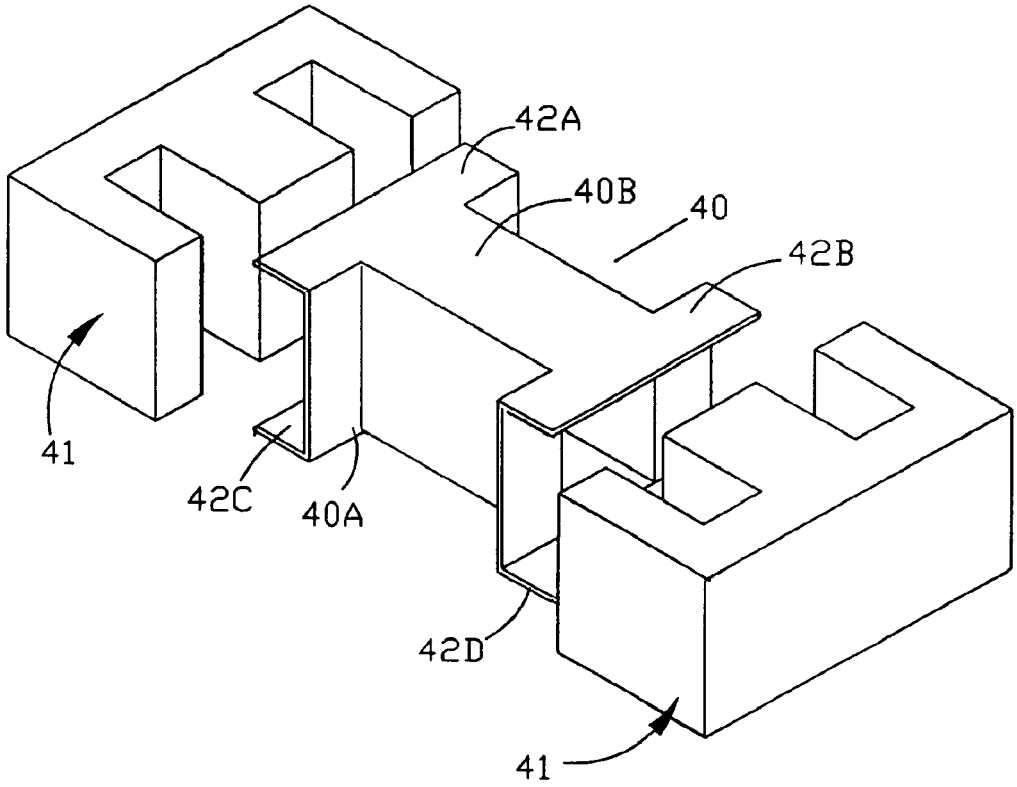
FIG. 4 is an exploded perspective view illustrating the bobbin of the invention.

FIG. 4 is an exploded perspective view illustrating the bobbin portion of the invention. Shown in FIG. 4 are bobbin 40 and two parts of transformer core 41. Bobbin 40 is different from a conventional bobbin (see FIG. 1). The flanges 40A of bobbin 40 are discontinuous as compared to a conventional bobbin. Discontinuous flange portions 42 are shaped to be planar or parallel with the adjacent body portion 40B. This new configuration is used to create four discontinuous flange portions 42A–42D on bobbin 42. This configurations permits winding exits which do not interfere with the windings. It also allows more windings on a layer or a smaller bobbin. The windings exit bobbin 40 via the discontinuous flange portions 42. An alternate embodiment envisions the elimination of discontinuous flange portions 42 which would create an aperture or gap in the flange 40.

Figure 5:
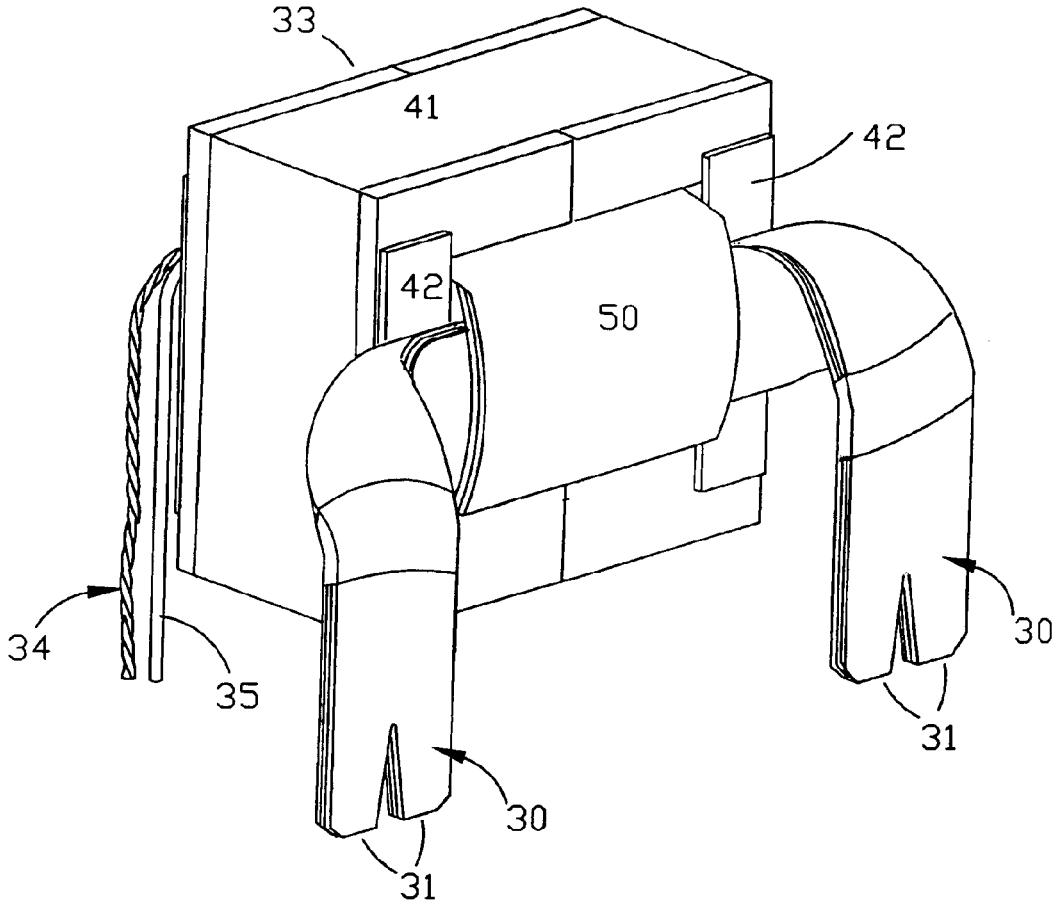
FIG. 5 is a perspective view of the invention as used for the secondary winding of a transformer.

FIG. 5 is a perspective view of the preferred embodiment of the invention used in a transformer. Shown in FIG. 5 are transformer 33, core 41, windings 50, conductive stacked self leads 30, trimmed legs 31, discontinuous flange portions 42, primary windings 34, and auxiliary windings 35. Self leads 30 exit the windings 50 via the discontinuous flange portions 42. Self leads 30 are bend to reach the printed circuit board (not shown). Self leads 30 are shown with trimmed legs 31 for insertion into holes in the printed circuit board.

Various changes in the details, steps and components that have been described may be made by those skilled in the art within the principles and scope of the invention herein illustrated and defined in the appended claims. For example, various kinds of coils, transformers, inductors, magnet wires, and foil conductors could be used with equivalent results. Similarly, various physical embodiments are also envisioned. Thus, while the present invention has been shown and described herein in what is believed to be the most practical and preferred embodiment, it is recognized that departures can be made therefrom within the scope of the invention, which is not to be limited to the details disclosed herein but is to be accorded the full scope of the claims so as to embrace any and all equivalent processes and products.

I claim:

1. A transformer comprising:

a foil winding having an end portion including one or more layers, at least one of said layers being divided to form a plurality of strips having conductive opposite sides;

wherein at least one strip is folded and at least one other strip is folded over said at least one strip to form a conductive stack portion; and wherein said conductive stack portion extends from said transformer and is secured to a mounting board.

2. The transformer of claim 1, wherein said conductive stack portion is secured to the mounting board by inserting an end of the conductive stack portion through a hole in the mounting board and at least two of said plurality of strips are bent in opposing directions to create a gap therebetween to secure the conductive stack portion to the mounting board.

3. The transformer of claim 2, wherein said end of the conductive stack portion is trimmed by removing a part thereof to facilitate insertion into said hole in the mounting board.

4. The transformer of claim 3, wherein said end of the conductive stack portion is trimmed into at least two leg portions.

5. The transformer of claim 1, further comprising a bobbin having a discontinuous flange with at least one section that is orthogonal to a main axis of the bobbin.

6. The transformer of claim 5, wherein said discontinuous flange further comprises at least one section that is parallel to the main axis of the bobbin.

7. A coil comprising:

a foil winding having an end portion including one or more layers, at least one of said layers being divided to form a plurality of strips having conductive opposite sides;

wherein at least one strip is folded and at least one other strip is folded over said at least one strip to form a conductive stack portion; and wherein said conductive stack portion extends from the coil and is secured to a mounting board.

8. The coil of claim 7, wherein said conductive stack portion is secured to said mounting board by inserting an end of the conductive stack portion through a hole in the mounting board and at least two of said strips are bent in opposing directions to create a gap therebetween to secure the conductive stack portion to the mounting board.

9. The coil of claim 8, wherein said end of the conductive stack portion is trimmed by removing a part thereof to facilitate insertion into at least one hole in the mounting board.

10. The coil of claim 9, wherein said end of the conductive stack portion is trimmed into at least two leg portions.

11. The coil of claim 7, further comprising a bobbin having a discontinuous flange with at least one section that is orthogonal to a main axis of the bobbin.

12. The coil of claim 11, wherein said discontinuous flange further comprises at least one section that is parallel to the main axis of the bobbin.

* * * * *